US008826469B2

(12) United States Patent
London

(10) Patent No.: US 8,826,469 B2
(45) Date of Patent: Sep. 9, 2014

(54) SAFETY NET HARNESS

(76) Inventor: Joseph Tony London, Stoneville, NC (US)

( * ) Notice: Subject to any disclaimer, the term of this patent is extended or adjusted under 35 U.S.C. 154(b) by 433 days.

(21) Appl. No.: 13/134,279

(22) Filed: Jun. 3, 2011

(65) Prior Publication Data

US 2012/0017360 A1 Jan. 26, 2012

Related U.S. Application Data

(60) Provisional application No. 61/399,906, filed on Jul. 20, 2010.

(51) Int. Cl.
*A41D 13/05* (2006.01)
*A41D 13/00* (2006.01)

(52) U.S. Cl.
CPC ..... *A41D 13/0007* (2013.01)
USPC ..... 2/455; D29/101.1

(58) Field of Classification Search
USPC ..... 2/455, 310, 311, 312, 321, 913, 102, 2/69; 482/124
See application file for complete search history.

(56) References Cited

U.S. PATENT DOCUMENTS

| | | | | | |
|---|---|---|---|---|---|
| 3,176,793 | A * | 4/1965 | Roland | 182/3 |
| 4,065,814 | A * | 1/1978 | Fox | 2/79 |
| 4,625,335 | A * | 12/1986 | Vinai | 2/69 |
| 4,731,882 | A * | 3/1988 | Ekman | 2/69 |
| 4,923,048 | A | 5/1990 | Cole | 182/9 |
| 4,991,689 | A | 2/1991 | Cole | 182/3 |
| 5,433,289 | A * | 7/1995 | O'Rourke | 182/3 |
| 5,509,142 | A * | 4/1996 | Connell et al. | 2/79 |
| 5,659,895 | A * | 8/1997 | Ford, Jr. | 2/2.11 |
| 5,926,846 | A * | 7/1999 | Segal | 2/102 |
| 6,824,106 | B2 * | 11/2004 | Douglas et al. | 244/151 R |
| 7,451,495 | B2 * | 11/2008 | Munn et al. | 2/94 |
| 7,854,694 | B1 * | 12/2010 | Frunzi | 482/124 |
| 7,926,117 | B2 * | 4/2011 | Parks et al. | 2/2.5 |
| 8,128,141 | B2 | 3/2012 | Chen | 294/82.2 |
| 8,544,114 | B2 * | 10/2013 | Williams et al. | 2/69 |
| 2005/0019736 | A1 * | 1/2005 | Noll | 434/253 |
| 2006/0054387 | A1 * | 3/2006 | Fortin | 182/3 |
| 2007/0015642 | A1 * | 1/2007 | Demeniuk | 482/124 |

(Continued)

FOREIGN PATENT DOCUMENTS

| | | |
|---|---|---|
| EP | 1 222 004 | 10/2000 |

OTHER PUBLICATIONS

American Society of Testing and Materials (ASTM) D 2061-03, 17 pages, dated Feb. 19, 2004.

*Primary Examiner* — Clinton T Ostrup
*Assistant Examiner* — Catherine M Ferreira
(74) *Attorney, Agent, or Firm* — Blake P. Hurt

(57) ABSTRACT

The present invention is a safety harness that is designed for persons who work at elevations of six feet (6') and above. It incorporates two panels of continuously knitted vertical and horizontal intersecting straps that are sewn together at the front and back to make a one piece half body suit with a zipper placed in the front for easy wear. The primary use will be with a fall arrest system that will connect to a t-shaped loop sewn to the back of the suit. This design gives not only support to the wearer while suspended but protects the femoral artery in case of extended hanging time after a fall by keeping the body in a horizontal position. Fall arrest forces are also distributed over the body, mainly the torso, which leads to better comfort and performance.

1 Claim, 5 Drawing Sheets

(56) References Cited

U.S. PATENT DOCUMENTS

2007/0135278 A1* 6/2007 Grigoriev et al. ..... 482/124
2009/0019623 A1* 1/2009 Uchida et al. ..... 2/455
2009/0031467 A1* 2/2009 Swindells et al. ..... 2/51
2009/0320188 A1* 12/2009 Johnson et al. ..... 2/455
2010/0011490 A1* 1/2010 Stinson et al. ..... 2/456
2010/0031427 A1* 2/2010 Smith et al. ..... 2/456

* cited by examiner

SAFETY NET HARNESS

CROSS-REFERENCE TO RELATED APPLICATIONS

This non-provisional patent application claims all benefits under 35 U.S.C. §119(e) of U.S. Provisional Application No. 61/399,906, filed on Jul. 20, 2010, in the United States Patent and Trademark Office. The disclosure of the above application is incorporated herein by reference in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

The present invention relates to a primary component of a personal fall arrest system and particularly pertains to a continuously knitted safety net harness to be worn by a person to protect that person from injury in case of a fall. The harness is designed to safely support a person being lifted or lowered as well as to sufficiently distribute fall arrest forces across the wearer's body if the harness is properly used as part of a fall arrest system.

2. Description of the Prior Art

Safety harnesses are widely used as part of a fall arrest system for persons subjected to a fall from a height of greater than six feet (6'). While these harnesses are generally used in the workplace, full body safety harnesses can be used in various other applications in which total suspension and support of the body must be ensured, either expectedly or unexpectedly.

Currently available full body safety harnesses as used with fall arrest systems typically include shoulder straps that are guided through a pad on the rear part of the harness worn on the person's back. The shoulder straps continue forward over the shoulders and after adjustment attach through buckles to a seat strap upon which the hindquarters of the wearer can rest and be supported. Adjustable leg straps attach to the seat strap through additional buckles to support the legs of the wearer. Although these harness types are well suited for fall protection, they cause discomfort to the user by, for example, impairing movement and digging into the body at the edges of the straps. The leg straps also restrict blood flow from the femoral artery which can cause loss of consciousness, blood clots, and even death. The limited range of motion and discomfort along with the physical hazards associated with the current safety harnesses can result in safety lapses by the user due to non-use.

It remains desirable to develop safety harnesses for use with fall arrest systems resulting in improved user comfort and overall safety that do not allow such disadvantages.

SUMMARY OF THE INVENTION

In general, the present invention provides a continuously knitted safety harness for use with fall arrest systems that is lightweight and uniquely designed as a half body suit comprising: a plurality of vertical and horizontal intersecting straps that create the front and back sides of the body suit, a t-shaped loop on the back side of the body suit for a tie-off, and a zippered front side of the body suit with a safety buckle for added security.

The present invention meets or exceeds most applicable requirements, including the guidelines and requirements found in ANSI Z359™ (American National Standards Institute Fall Protection Guidelines), CSA™ (Compliance, Safety, Accountability) and OSHA™ (Occupational Safety & Health Administration), while creating a more comfortable, less stressful on the body, user-friendly safety net harness. The half body suit keeps the wearer in a horizontal position and distributes fall arrest forces across the body, mainly the torso. Additionally, the half body suit can be worn as a safety vest because of its unique and lightweight design that requires no adjustment as with standard harnesses.

The primary intention of the present invention is to provide a safety net harness suit for use in personal fall arrest systems by utilizing the t-shaped loop as a D-ring device to connect to a fall arrest system eliminating the need for a metal D-ring. The suit comes in several sizes (small, medium, large, extra large, large-tall, extra large-tall) and colors (neon yellow, orange, black, pink, green). It is designed to weigh less than two (2) pounds while having a capacity of one person weighing up to three hundred ten (310) pounds including tools, clothing, and other user-borne objects.

DETAILED DESCRIPTION OF THE INVENTION

Figure 1:
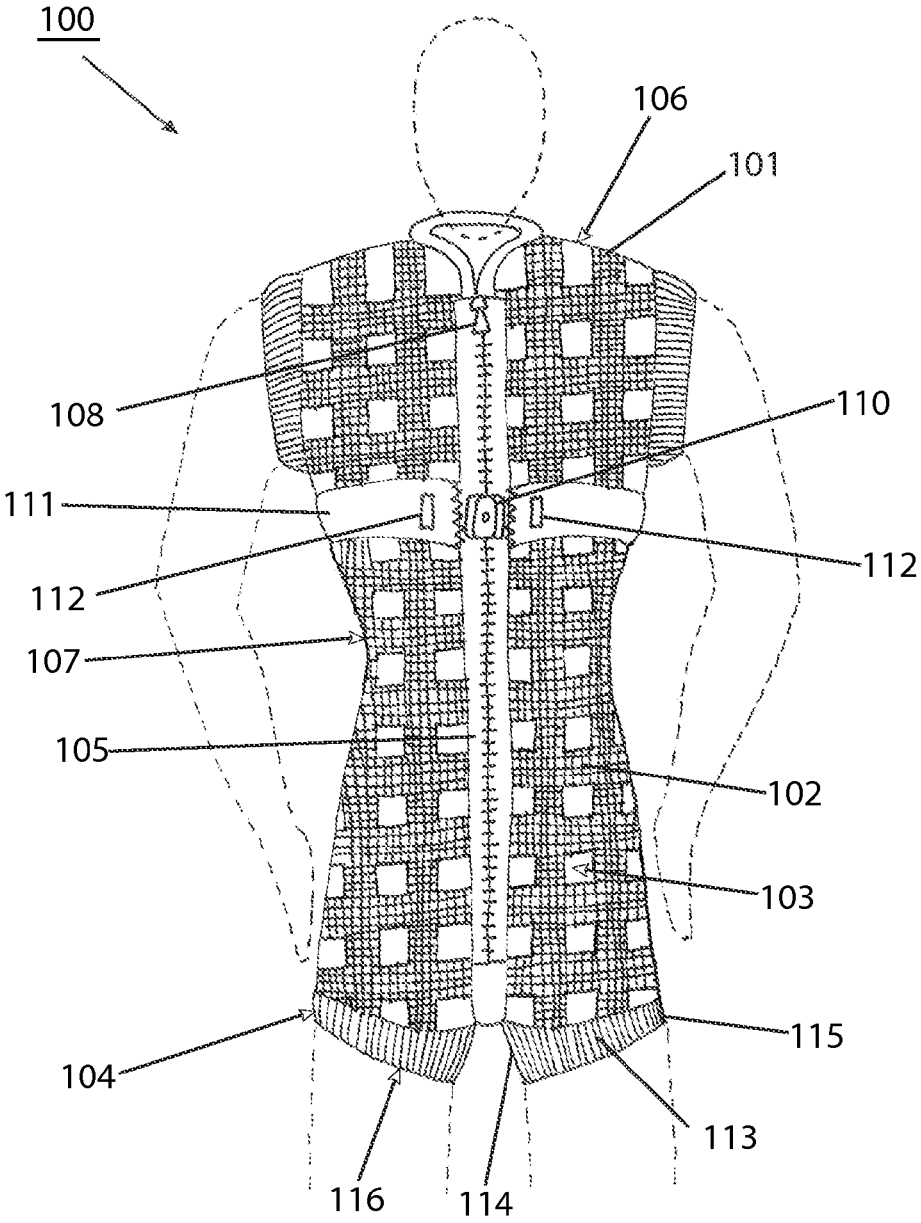
FIG. 1 illustrates a front view of a safety net harness half body suit under the present invention.
Figure 2:
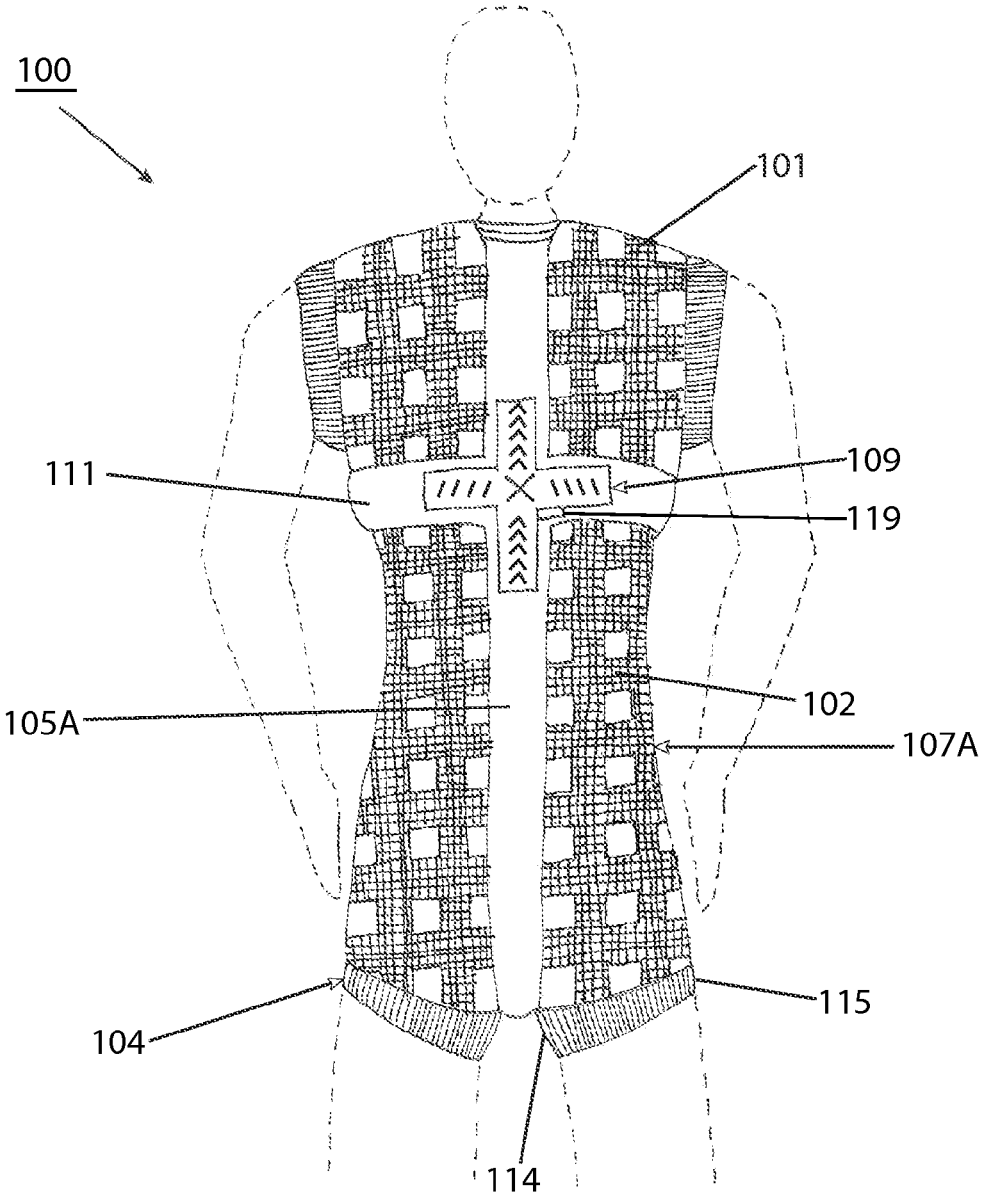
FIG. 2 illustrates a rear view of a safety net harness half body suit under the present invention.
Figure 3:
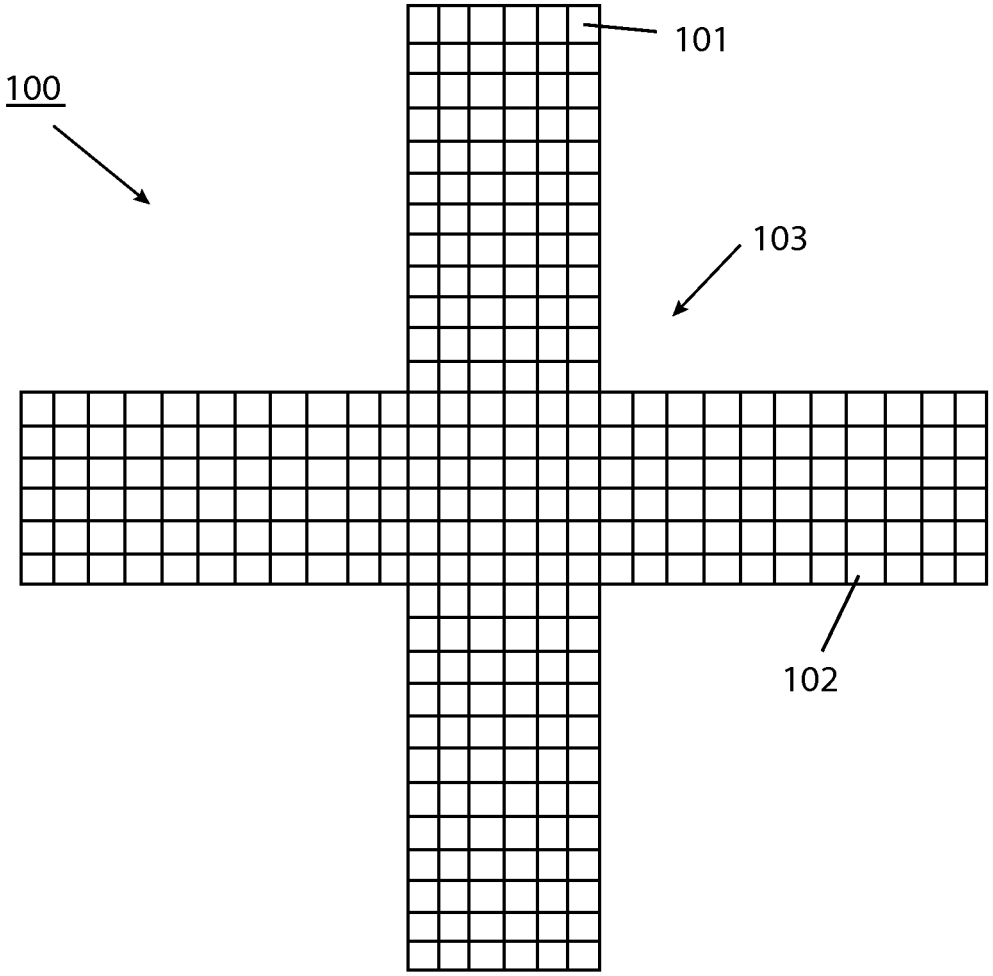
FIG. 3 illustrates a top plan view of a continuously knitted horizontal and vertical strap structure utilizing six hundred thirty (630) denier nylon in the present invention.

Referring to FIGS. 1 and 2 respectively, a front and rear view embodiment of a continuously knitted safety harness 100 of the present invention are shown. Safety harness 100 is an overall net-like half body suit, meaning that the suit covers roughly half of the user's body when worn. It is made by sewing together two continuously knitted panels to form a one-piece design, as shown in FIG. 3. The main body is formed by vertical straps 101 and horizontal straps 102 intersecting to construct a two inch by two inch (2"×2") cross pattern hole 103. Straps 101, 102 are knitted on a flat bed knit machine with one end of six hundred thirty (630) denier nylon using a tubular and interlock stitch. The two panels are sewn together at bands 105 and 105A with one hundred thirty-five (135) Anefil Nylon® thread and a chain stitch using an industrial sewing machine. There is a two inch (2") wide inseam 114 and one inch (1") wide outer seam 115 on cuff 113 on each leg 104 knitted on a thirty degree (30°) slope 116 with one end of eight hundred forty (840) denier nylon. A two inch (2") wide horizontal band 111 is knitted using one end of eight hundred forty (840) denier nylon and is sewn four inches (4")

below the underarms to go around the entire garment 106 allowing for the same point of attachment for all garment sizes. Sizes will range from small, medium, large and extra large to tall sizes in large and extra large. There will also be a variety of colors, for example neon yellow, orange, black, pink and green. There is a vertical knitted band 105 in the front 107 of the main body used for placement of a three hundred pound (300 lb) pull, number ten (#10) spiral plastic zipper 108 sewn in using a chain stitch and one hundred thirty-five (135) Anefil Nylon® thread. The zipper 108 is held in the closed position by a locking slider that is a component of the zipper 108 and a two hundred pound (200 lb) pull double locking safety buckle 110.

Figure 4:
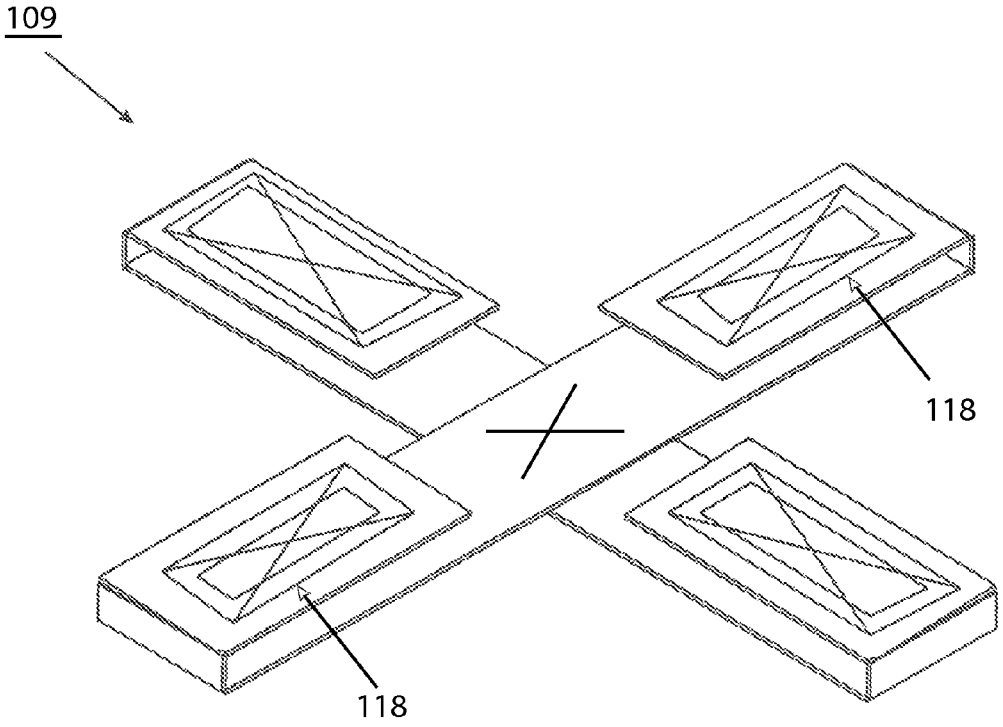
FIG. 4 illustrates an underside view of the X-box stitching of the t-shaped loop on the back of a safety net harness body suit used in the present invention.
Figure 5:
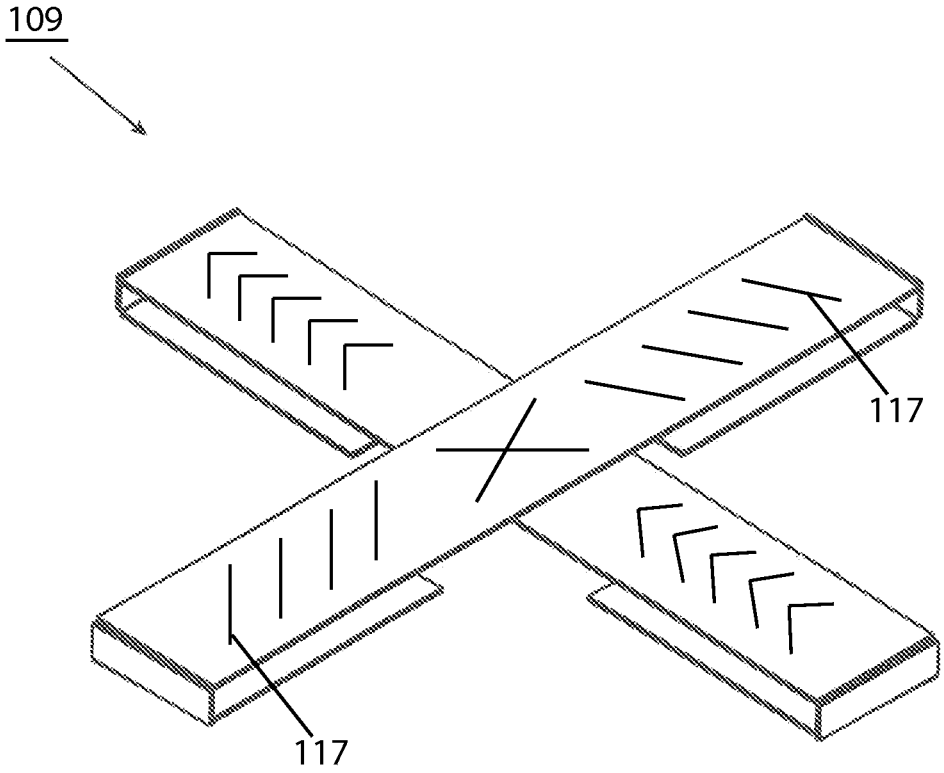
FIG. 5 illustrates a top view of the straight line stitching of the t-shaped loop on the back of a safety net harness body suit used in the present invention.

A vertical knitted band 105A in the back 107A of safety harness 100 is used for placement of the tie-off point. A single t-shaped knitted loop 109 is the tie-off point and a strippable lanyard. Tag 119 (FIG. 2) will be displayed showing the lanyard out of service after a fall so that the safety body suit can not be used again. FIG. 4 shows the underside of the loop sewn in a four pass X-box fashion stitching 118 for strength. FIG. 5 shows the upper side of the t-shaped loop 109 sewn in a two pass stitching fashion which allows the strippable t-shaped loop 109 to be a lanyard. Sewing is done using a chain stitch 117 and one hundred thirty-five (135) Anefil Nylon® thread. Vertical knitted straps 112 placed to the right and left of the zipper 108 are to be used for placement of front tie-off points.

Through testing, breaking strength has been determined to exceed five thousand pounds (5000 lbs) of force. The harness is lightweight at less than two pounds (2 lbs) and breathable. The developed design of safety harness 100 is comfortable enough to be worn all day and can double as a safety vest, if necessary. It has also been determined through testing that this design is better suited for taking pressure off of the femoral artery. Restriction in this area can cause suspension trauma, which can lead to blood clots and death. In the event of a fall, force is distributed over the body. Rather than being held upright, the half body suit allows for a horizontal position so that there is minimal restriction on the femoral artery.

It should be understood, however, that the detailed description of safety harness 100 and specific examples, while indicating the preferred representation of the invention, are intended for purposes of illustration only and not intended to limit the scope of the invention.

What is claimed is:

1. A safety harness suit with breaking strength exceeding five thousand pounds (5000 lbs) of force comprising: a plurality of vertical knitted straps, a plurality of horizontal knitted straps, said vertical and horizontal straps formed from six hundred thirty (630) denier nylon, said vertical straps perpendicularly and continuously intersecting said horizontal straps, said vertical and horizontal straps defining a suit front and a suit back, said suit front and back connected with a chain stitch, said intersecting vertical and horizontal straps defining a plurality of two inch by two inch (2"×2") square openings, a pair of vertical knitted bands, each of said vertical bands affixed in opposing relation to different ones of said suit front and said suit back, a horizontal band, said horizontal band encircling said suit and intersecting said pair of vertical bands, a spiral plastic zipper, said zipper capable of withstanding three hundred pounds (300 lbs) of force and positioned along said front vertical band, a double locking safety buckle, said buckle sewn on said suit front at opposing ends of said horizontal band with a chain stitch using one hundred thirty-five (135) denier nylon thread, said buckle engaging said zipper, said buckle capable of withstanding two hundred pounds (200 lbs) of force, a knitted t-shaped loop, said t-shaped loop formed from one hundred thirty-five (135) nylon thread and attached proximate the intersection of said horizontal band and said suit back vertical band, a tag, said tag connected to said t-shaped loop, a pair of nylon tie-off straps, each of said tie-off straps positioned on said horizontal band on each side of said zipper, wherein said suit defines a pair of legs, a pair of cuffs, each of said pair of cuffs attached to different ones of said pair of legs, each of said pair of cuffs comprising an inseam and an outer seam, said pair of cuffs formed from eight hundred forty (840) denier nylon and knitted to define a thirty degree (30°) slope relative to said inseam and said outer seam.

* * * * *